US005242284A

United States Patent [19]

Mitsunaga et al.

[11] Patent Number: 5,242,284

[45] Date of Patent: Sep. 7, 1993

[54] SCROLL COMPRESSOR HAVING LIMITED AXIAL MOVEMENT BETWEEN ROTATING SCROLL MEMBERS

[75] Inventors: Toshihiko Mitsunaga; Yoshinori Noboru; Kazuyoshi Sugimoto; Denji Mashimo, all of Oizumi; Yoshio Ishiai, Ota, all of Japan

[73] Assignee: Sanyo Electric Co., Ltd., Osaka, Japan

[21] Appl. No.: 809,493

[22] PCT Filed: Apr. 23, 1991

[86] PCT No.: PCT/JP91/00530

§ 371 Date: Jan. 10, 1992

§ 102(e) Date: Jan. 10, 1992

[87] PCT Pub. No.: WO91/18207

PCT Pub. Date: Nov. 28, 1991

[30] Foreign Application Priority Data

May 11, 1990 [JP] Japan ..... 2-121980
Jul. 6, 1990 [JP] Japan ..... 2-180078

[51] Int. Cl.[5] ..... F04C 18/04; F04C 27/00

[52] U.S. Cl. ..... 418/55.3; 418/55.4; 418/55.5; 418/57

[58] Field of Search ..... 418/55.3, 55.4, 55.5, 418/57, 188

[56] References Cited

U.S. PATENT DOCUMENTS 4,600,369 7/1986 Blain ..... 418/55.5
4,927,339 5/1990 Riffe et al. ..... 418/55.5
5,129,798 7/1992 Crum et al. ..... 418/55.5

FOREIGN PATENT DOCUMENTS 62-60901 3/1987 Japan .
64-302 1/1989 Japan .
1-35196 7/1989 Japan .

*Primary Examiner*—John J. Vrablik
*Attorney, Agent, or Firm*—Wenderoth, Lind & Ponack

[57] ABSTRACT

A scroll compressor has a first scroll member and a second scroll member rotated in the same direction as the first scroll member. A limit plate is provided to limit an axial movement of one of the scroll members with respect to the other. A pressure chamber is formed between the limit plate and an end plate of the scroll member, and the pressure chamber is connected to a compression space formed by the two scroll members. A resilient sealing device is provided in the pressure chamber so that the sealing device is contacted with at least one of the limit plate and the end plate of the scroll member.

19 Claims, 4 Drawing Sheets

SCROLL COMPRESSOR HAVING LIMITED AXIAL MOVEMENT BETWEEN ROTATING SCROLL MEMBERS

TECHNICAL FIELD

The present invention relates to a scroll compressor having a driving scroll member and a driven (idling) scroll member directly rotated by the driving scroll member wherein the two scroll members are rotated in the same direction.

BACKGROUND OF THE INVENTION

A conventional scroll compressor is shown in, for example, Japanese Patent Publication No. 1-35196/1989 (examined), in which the first and second scroll members, in an eccentric relation with each other, are rotated in the same direction to compress a refrigerant in a compression space to thereby reduce vibration at the time of compression, so that the scroll compressor can be used for high-speed and/or large scale applications.

However, in the conventional scroll compressor, sealed space is formed between an end plate of the first scroll member and a confronting first housing by a slide ring, and, similarly, a sealed space is formed between an end plate of the second scroll member and a confronting second housing, and a refrigerant in the compression space is supplied to the sealed spaces to thereby press the first and second scroll members. At the start of operation, however, a gap in the axial direction is enlarged more than necessary and the compression within the compression space is substantially delayed, with the result that the refigeration capacity at the initial stage of the start of the operation is lowered. Further, since the rotational portions are sealed by the slide rings, relative rotation speed of the rotational sealing portions becomes higher, resulting in failures in durability and in the sealing effect of the slide rings.

In addition, an Oldham's ring is provided outside the rotating scroll compressor unit, which is disposed between the end plate of the first scroll member and a flange of the second scroll member and, therefore, the entire structure becomes large, and it does not meet with a small-size requirement.

SUMMARY OF THE INVENTION

An object of the present invention is to provide an improved scroll compressor solving the problems encountered in the conventional scroll compressor.

Another object of the present invention is to provide improved scroll compressor which has a constant gap in the axial direction of the first and second scroll members, and improved durability and sealing effects at the sealing portions of the scroll members.

A further object of the present invention is to provide a scroll compressor of a reduced size.

According to the present invention, there is provided a scroll compressor incorporating an electric motor unit and a scroll compressor unit in a sealed container, wherein the scroll compressor unit has a first scroll member having an end plate, a wrap of an involute curve projecting from one side of the end plate, and a rotary shaft projecting from the other side of the end plate and connected to the electric motor units. A second scroll member has an end plate with a wrap of an involute curve projecting from the other side of the end plate of the second scroll member. A main frame rotatably supports the shaft of the first scroll member and a subsidiary frame rotatably supports the shaft of the second scroll member. The wrap of the first scroll member is in a juxtaposed engagement relation with the wrap of the second scroll member, and the shaft of the second scroll member is eccentrically spaced from the shaft of the first scroll member so that the wraps of the two scroll members are fitted closely together to form a plurality of compression spaces. A driving device rotates the second scroll member in the same direction as the first scroll member to continuously compress the compression space radially inwardly from an outer position to an inner position. A limit means is disposed on one of the first and second scroll members for limiting axial movement of the other of the first and second scroll members, and a pressure means is formed between the limit means of the one of the two scroll members and the end plate of the other of the two scroll members.

In a first embodiment of the invention, the limit means is disposed on one scroll member to limit axial movement of the other scroll member, as described above. The pressure means formed between the limit means and the other one of the two scroll members is hermetically sealed on the inner surface thereof with a resilient sealing member so that the refrigerating capacity is not lowered, even when the contact force between the first and second scroll members is small at the initial stage of operation. In addition, an axial gap between the first and second scroll members is maintained constant in normal operation so that an improvement in the refrigerating capacity can be obtained.

In the second embodiment of the invention, the limit means is disposed on one scroll member to limit axial movement of the other scroll member. A pressure chamber is formed between the other scroll member and the limit means in such a manner that the pressure chamber is connected to the compression space in the compression step, and a discharge port is provided to one of the shafts for the first and second scroll members. The limit means has a guide portion for slidably engaging a connector which rotates the other scroll member in the same direction as the one scroll member.

In the second embodiment described above, the connector is slidably mounted on the limit means so that reduction of the refrigerating capacity can be prevented at an initial stage of operation by the limit means. Further, the driving force of the first scroll is delivered to the second scroll member by the connector and, accordingly, the thus formed connector can prevent the entire size of the scroll compressor from being enlarged.

PREFERRED EMBODIMENT OF THE INVENTION

Figure 1:
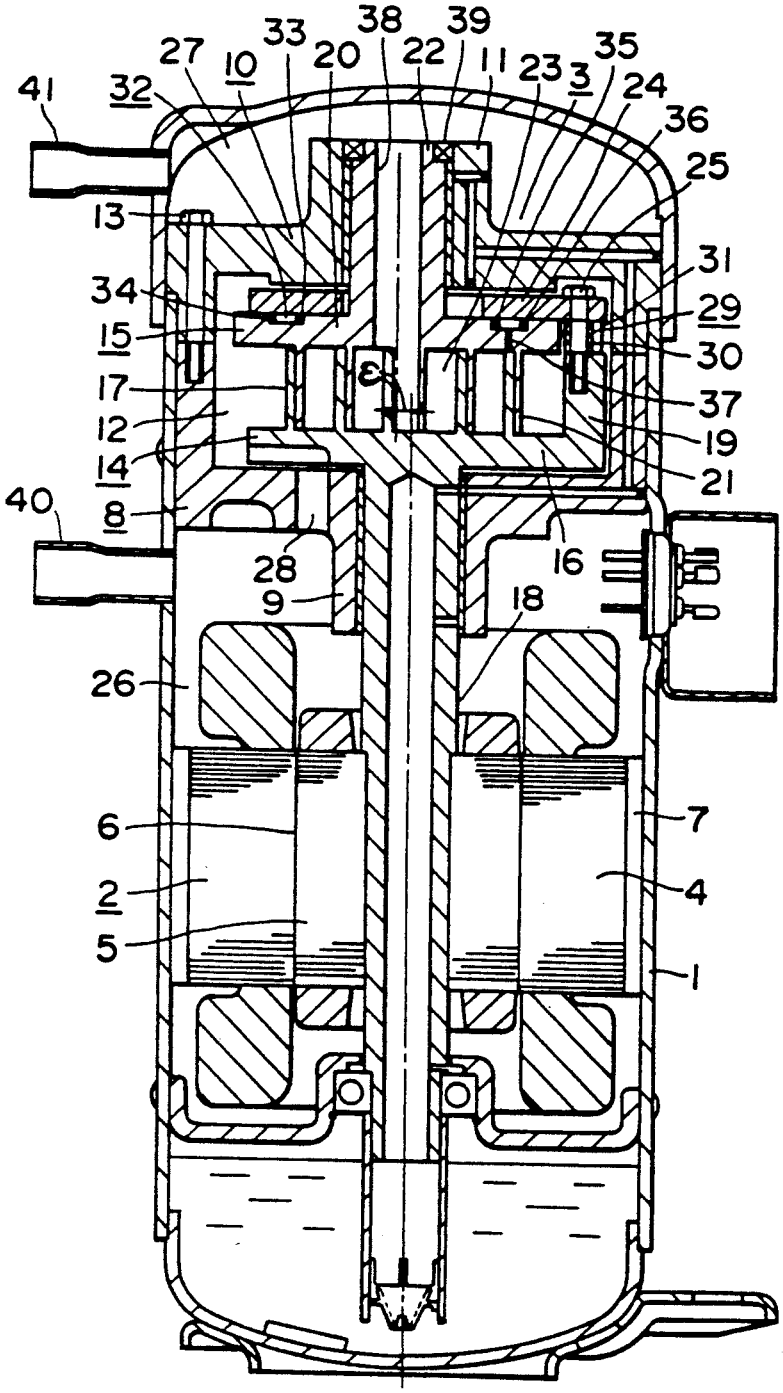
FIG. 1 is a sectional elevation of a scroll compressor embodying the present invention.

A first preferred embodiment of the present invention will be described with reference to FIGS. 1 and 2.

An electric motor unit 2 and a scroll compressor unit 3 are disposed at a lower portion and an upper portion, respectively, in a sealed container 1. The electric motor unit 2 has a stator 4 and a rotor 5 inside the stator 4 with an air gap 6 therebetween. A passage 7 is formed on the outer surface of the stator 4 by partly cutting out the outer surface of the stator. A main frame 8 is press-fitted to an inner surface of the sealed container 1 and is provided with a main bearing 9 at a center thereof and, similarly, a subsidiary frame 10 is press-fitted to the inner surface of the sealed container 1. The .subsidiary frame 10 has a subsidiary bearing 11 at a center thereof but spaced from the main bearing 9 of the main frame 8 by a distance "$\epsilon$", and the main frame 8 and the subsidiary frame 10 are connected together by bolts 13 to form a chamber 12.

The scroll compressor unit 3 has a first scroll member 14 (i.e., a driving scroll) and a second scroll member 15 (i.e. an idler or driven scroll) rotated in the same direction as the driving sçroll 14. The driving scroll member 14 has a tubular end plate 16 having a projection 19 on the outer circumference thereof, a spiral wrap 17 extending from an upper surface of the end plate 16 in an involute curve configuration, and a driving shaft 18 projecting from the center of the lower surface of the end plate 16 to be fitted fixedly into a bore of the rotor 5. The driven scroll member 15 has a disc end plate 20, a spiral wrap 21 extending from a surface of the end plate 20 in an angle-corrected involute curve configuration, and an idler shaft 22 extending from the other surface of the end plate 20.

The spiral wrap 17 of the driving scroll 14 has coordinates which are obtained by:

$$X=R\ (\cos\theta+\theta\sin\theta)$$

$$Y=R\ (\sin\theta-\theta\cos\theta)$$

and the spiral wrap 21, in an angle-corrected involute curve, of the driven scroll 15, has coordinates which are obtained by:

$$X=-R\ [\cos\theta+(\theta+\beta)\sin(\theta+\beta)]$$

$$Y=-R\ [\sin\theta-(\theta+\beta)\cos(\theta+\beta)]$$

$$\beta=\tan^{-1}\{P\sin\theta/(P\cos\theta+\epsilon)\}$$

wherein:

R: a radius of a basic circle

P: a radius of a circle orbit of a driving pin $\theta$: a rotary angle of the driving shaft, and $\epsilon$: the distance between the axes of the driving scroll and the driven scroll The driving scroll 14 and the driven scroll 15 are placed in a confronting engagement relation in the chamber 12 formed by the main frame 8 and the subsidiary frame 10 so that the wraps 17 and 21 of the two scroll members 14 and 15 are contacted with each other at a plurality of points to form a plurality of compression spaces 23.

A limit plate 24 for limiting axial movement of the second scroll member 15 is made of a metal ring and is fixed to the projection 19 of the driving scroll member 14 in such a manner that it is contacted with the end plate 20 of the driven scroll member 15 and is fixed to the projection 19 of the driving scroll member by a bolt 25.

The interior of the sealed container 1 is divided into a low pressure chamber 26 and a high pressure chamber 27 by the main frame 8 and the subsidiary frame 10. The chamber 12 is connected to the low pressure chamber 26 through a port 28.

A driving device 29 has a driving member, such as a tubular pin 30 around the bolt 25, between the projection 19 of the first scroll, member 14 and the limit plate 24, and a guide groove 31 extending in a radial direction on the end plate 20 of the second scroll member 15.

The guide groove 31 is formed in a U-shape by cutting an outer portion of the driven scroll 15 so that a circle orbit of the outer circumferential end of the guide groove 31 is positioned outside a circle orbit of the center of the driving member 30.

The driven scroll member 15 has an annular groove on the end plate 20 to form an annular pressure chamber 32 on one surface in a confronting relation with the limit plate 24. In the annular pressure chamber 32, sealing rings 33 and 34 each of which has a C-shape in cross section are mounted therein along inner and outer circumferential walls, respectively, of the annular chamber 32, and resilient members such, as metal wires 35 and 36 are disposed in the gap of the C-shaped sealing rings to substantially maintain the shape of the sealing rings 33 and 34. The annular pressure chamber 32 is connected to the compression space 23, which is in the process of compression, through a small hole 37 in the end plate 20 of the second scroll member 15.

Figure 2:
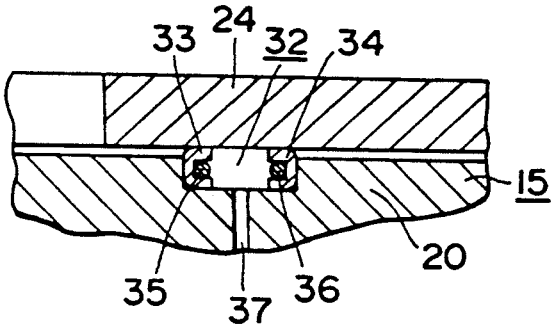
FIG. 2 is an enlarged sectional view of a resilient sealing member of FIG. 1, in the scroll member.
Figure 2A:
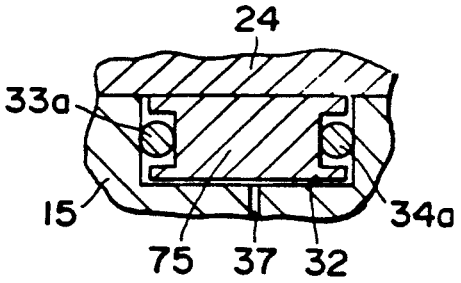
FIG. 2A is a sectional view of a resilient sealing member in a modified form.

The sealing rings 33 and 34 may be modified to the structure as illustrated in FIG. 2 A, in which a ring-shaped slidable member 75 having highly wear-resistant properties is fitted into the annular pressure chamber 32 with sealing rings 33*a* and 34*a* disposed along inner and outer circumferential recesses or grooves of the slidable member 75. The modified structure shown in FIG. 2A is advantageous in that the sealing rings in the annular pressure chamber 32 are not directly contacted with a sliding surface of the limit plate 24 and, consequently, wearing of the sealing rings can be minimized.

Referring again to FIGS. 1 and 2, the idler shaft 22 has a discharge port 38 for discharging therethrough a compressed refrigerant in the compression space 23 into the high pressure chamber 27.

The chamber 12 and the high pressure chamber 27 are separated from each other and hermetically sealed by a sealing member 39 disposed on the sliding surface between the subsidiary bearing 11 and the idler shaft 22.

In FIG. 1 of the drawing, reference numeral 40 represents a suction pipe connected to the low pressure chamber 26 and reference numeral 41 a discharge pipe connected to the high pressure chamber 27.

In the scroll compressor according to the present invention as described, when the electric motor unit 2 is driven, a rotational force of the motor unit 2 is delivered to the driving scroll member 14 through the main driving shaft 18, and then to the driven scroll member 15 through the driving device 29 so that the driven scroll member 15 is rotated in the same direction as the driving scroll member 14 while the driven scroll member 15 is held by the limit plate 24 and the driving scroll member 14. The idler shaft 22 of the driven scroll member 15 is eccentrically spaced from the driving shaft 18 of the driving scroll member 14 by a distance "ε" and accordingly the driven scroll member 15 is eccentrically rotated relative to the driving scroll member 14. Thus, the compression space 23 is gradually reduced in its volume as it is moved inwardly from an outer position to an inner position of the spiral wraps, and the refrigerant flowing from the suction pipe 40 into the low pressure chamber 26 is directed into the compression space 23 for compression purposes through the hole 28 of the main frame. The thus compressed refrigerant is fed to the dicharge port 38 of the idler shaft 22 of the driven scroll member 15 and then to the high pressure chamber 27, and after that discharged out of the sealed container through the discharge pipe 41. If the refrigerant is in a mid-compression stage and is of a middle pressure, it is discharged into the pressure chamber 32 from the small through-hole 37 so that it serves as a back pressure of the driven scroll member 15.

The limit plate 24 is fixed to the projection 19 of the driving scroll member 14 by the bolt 25 to thereby limit the axial movement of the driven scroll member 15. Thus, a gap of the projected ends of the wraps 17 and 21 for the driving and driven scroll members, respectively, is limited to a predetermined value or less so that the refrigerating capacity is not lowered at the start of operation, whereat the axial force for pushing the driven scroll member 15 toward the driving scroll member 14 is relatively small.

The pressure chamber 32 is hermetically sealed from the chamber 12 by the sealing rings 33 and 34 so that refrigerant discharged from the compression space 23 through .the small hole 37 does not leak into the chamber 12. Specifically, the sealing rings 33 and 34 are deformed at their sectionally C-shaped ends to contact both the limit plate 24 and the end plate 20, and the driven scroll member 15 is forced toward the driving scroll member 14 by the refrigerant pressure within the pressure chamber 32. Accordingly, even when the gap between the driven scroll member 15 and the limit plate 24 becomes large, the refrigerant in the pressure chamber 32 is prohibited from leaking into the chamber 12. Further, the sealing rings 33 and 34 are disposed in the driven scroll member 15 having an orbiting movement, which presents a relatively slow frictional movement with respect to the rotation of the limit plate 24 and, therefore, a reduction of the durability and of the sealing effect can be prevented.

The metal wires 35 and 36 provided in the recess of the C-shaped, sealing rings 33 and 34 can prevent the sealing rings 33 and 34 from being collapsed or crushed and maintain the desired sealing effect of the sealing rings in the pressure chamber 32. In order to avoid the structure in which the sealing rings are contacted frictionally with a rotating element such as the limit plate 24, the slidable ring 75 of highly wear-resistant properties, with sealing rings 33*a* and 34*a* attached thereto, can be provided as described with reference to FIG. 2A. This structure of FIG. 2A can prevent undesirable wearing of the sealing rings.

According to the present invention, a limit member such as the limit plate 24 is provided on one scroll member 14 to limit the axial movement of the other scroll member 15 toward the scroll member 14, and the pressure chamber 32 connected to the compression space 23 is formed between the limit plate and the other scroll member 15 so that a resilient sealing device, such as the sealing rings 33 and 34, provided in the pressure chamber 32, are contacted with the limit plate 24 and the end plate of the other scroll member 15. Accordingly, the two scroll members 14 and 15 can be placed in a mutually engaged relation with an axially limited force, and the axial sealing force of the two scroll members can be improved. Further, a gap in an axial direction between the two scroll members can be maintained constant and, consequently, the refrigerating capacity at the initial stage of operation can be improved.

Figure 3:
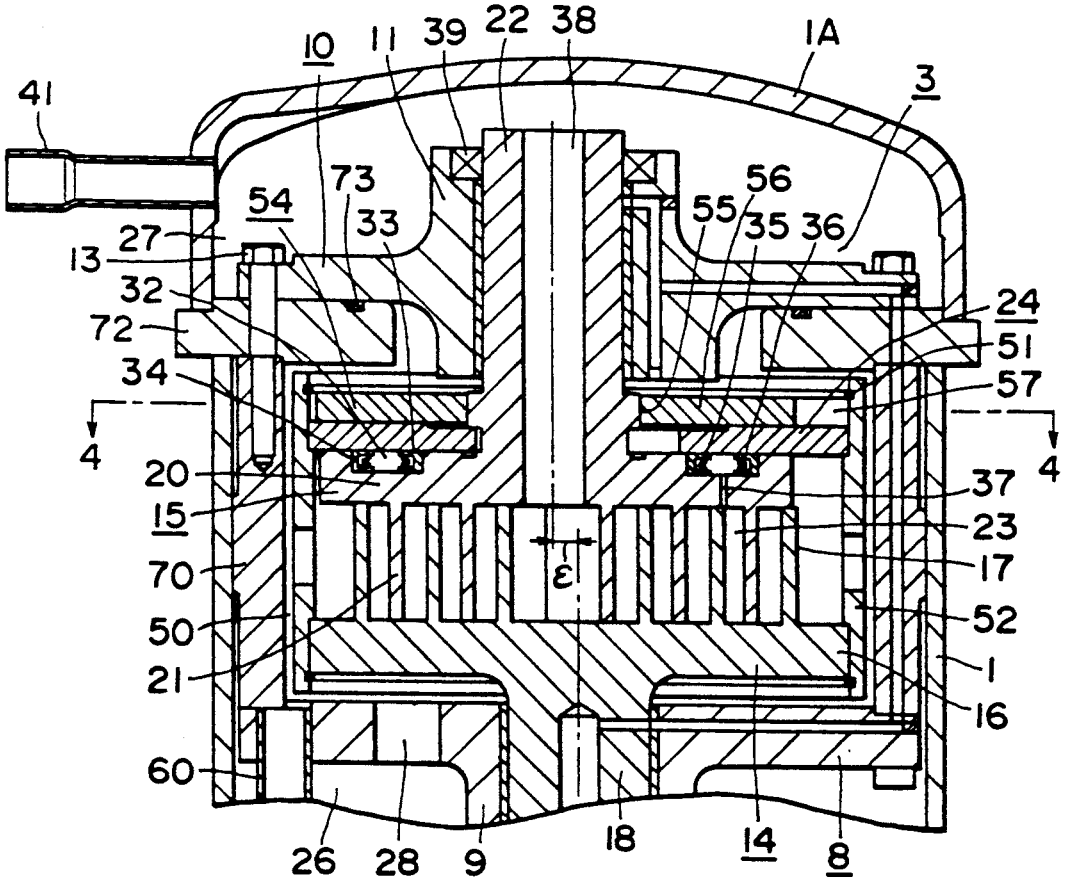
FIG. 3 is a sectional view of a part of a scroll compressor according to another embodiment of the invention.
Figure 4:
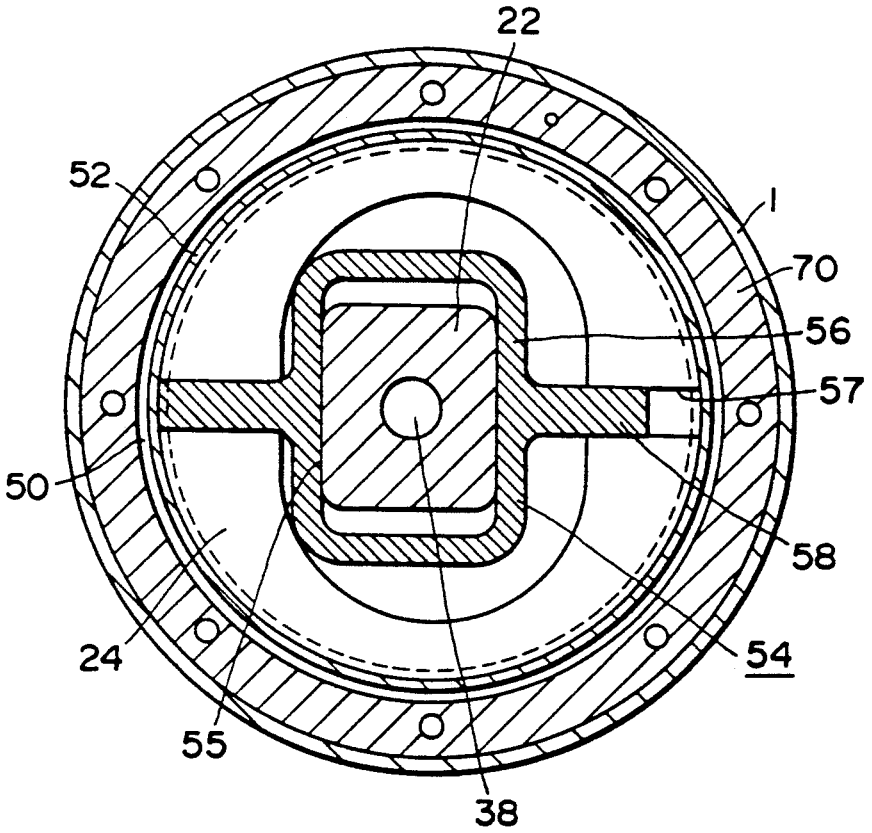
FIG. 4 is a sectional view taken along line 4—4 in FIG. 3.

FIGS. 3 and 4 show another embodiment of the present invention, in which a tubular frame 70 is provided between the main frame 8 and the subsidiary frame 10, which is slightly modified in shape relative to the frame 10 of the first embodiment of FIG. 1, so that a space 50 is formed The limit plate 24 which limits axial movement of the driven scroll member 15 is of a ring-shape and contacts the end plate 20 of the driven scroll member 15. The limit plate 24 in this embodiment is contacted with the end plate 20 of the driven scroll member 15 and is fitted to a tubular member 52 which is fixed to the outer circumference of the end plate 16 of the driving scroll member 14.

In the embodiment of FIGS. 3 and 4, a separation plate 72 is disposed between the sealed container 1 and a cover 1A, the separation plate 72 is held between the subsidiary frame 10 and the tubular frame 70, and the separation plate 72 is unitarily deposited between the sealed container 1 and the cover *a*. A sealing material 73 is provided between the subsidiary frame 10 and the separation plate 72.

A driving device 54 has a ring 56 which is fitted to a sliding surface 55 on an outer circumference of the idler shaft 22 of the driven scroll member 15, and a key 58 is slidably fitted to a key groove 57 which is formed on the limit plate 24 at a right angle to the sliding surface 55 of the idler shaft 22.

By the separation plate 72, the interior of the sealed container 1 is divided into the low pressure chamber 26 and the high pressure chamber 27. The space 50 is connected with the low pressure chamber 26 through the hole 28 of the main frame 8. The main frame 8 has a pipe 60 for discharging the oil stored in the space 50 of the main frame 8 into the low pressure chamber 26.

The idler shaft 22 has the discharge port 38 for discharging the compressed refrigerant in the compression space 23 into the high pressure chamber 27.

In the embodiment of FIGS. 3 and 4, the limit plate 24 is fitted to the tubular member 52 fixed to the outer circumference of the end plate 16 of the driving scroll member 14 to thereby limit axial movement of the driven scroll member 15. Thus, the clearance at the end of the wraps 17 and 21 of the driving and driven scroll member 14 and 15, respectively, is limited to a predetermined value or less so that the refrigerating capacity is not lowered at the time of start of operation, at which the axial force for moving one scroll member toward the other scroll member is relatively small.

The annular pressure chamber 32 is hermetically shielded from the space 50 by the sealing rings 33 and 34 so that the refrigerant discharged from the compression space 23 through the small hole 37 is not introduced into the space 50. More specifically, the sealing rings 33 and 34 are deformed outwardly at the upper and lower portions of their C-shaped cross section by the refrigerant discharged from the compression space 23, and the driven scroll member 15 is axially forced toward the driving scroll member 14. Thus, the refrigerant in the pressure chamber 32 is prevented from leaking into the space 50.

Figure 5:
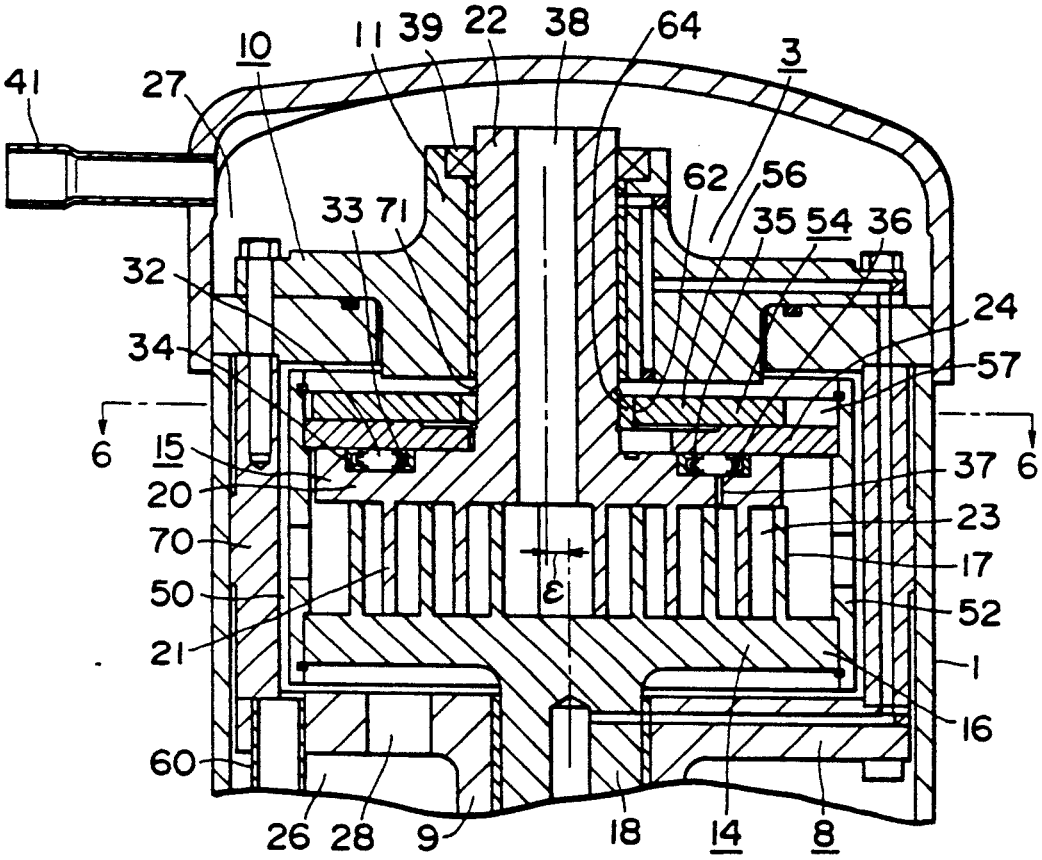
FIG. 5 is a sectional view of a part of a scroll compressor according to another embodiment of the invention.
Figure 6:
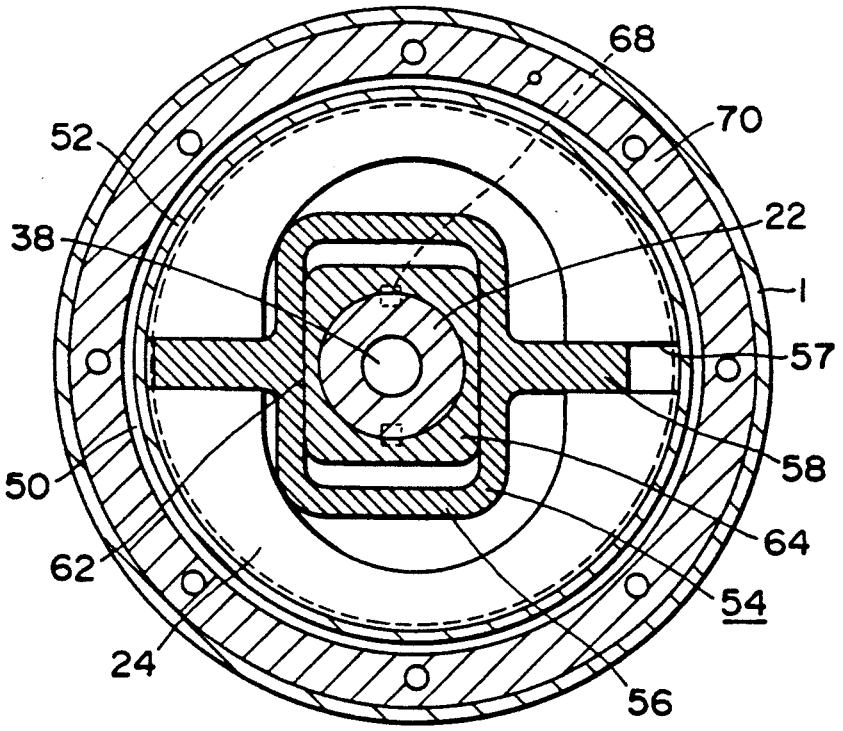
FIG. 6 is a sectional view taken along line 6—6 in FIG. 5

The ring 56 of the driving device 54 is mounted on the slide surface 55 of the idler shaft 22 of the driven scroll member 15, and the key is fitted in the key groove 57 of the limit plate 24 fixed to the driving scroll member 14 so that the driven scroll member 15 is rotated in the same direction as the driving scroll member 14, which is driven by the electric motor unit 2 (FIG. 1). Since the driving device 54 is engaged with both the idler shaft 22 and the limit plate 24, which limits an axial movement of the driven scroll member 15, the driving device 54 can be positioned inside the compressor unit 3 and, therefore, an expansion of the outer dimension of the sealed container 1 can be prevented. In the embodiment described above, the slide surface 55 is formed integrally with the idler shaft 22 of the driven scroll member 15. However, a modification can be made as illustrated in FIGS. 5 and 6. In the embodiment of FIGS. 5 and 6, a ring-like member 64 having a slide surface 62 is mounted in the ring 56 of the driving device 54 so that the ring-like member 64 is fixed by fixing members 68 disposed on the idler shaft 22 and stop rings 71 disposed at upper and lower axial positions on the idler shaft 22. Other structural features of the embodiment of FIGS. 5 and 6 are substantially similar with those of the previous embodiment of FIGS. 3 and 4.

In the embodiments of FIGS. 3 to 6, the limit plate which can restrict axial movement of the driven scroll member is provided with a guide device which slidably contacts the driving device and, therefore, the driving device is not affected in an axial direction by the pressure in the compressed space produced by the two scroll members, and wearing of the driving device can be minimized. Further, since the driving device can be mounted inside the compression unit, the size, particularly the outer diameter, of the scroll compressor can be reduced desirably.

What is claimed is;

1. A scroll compressor incorporating an electric motor unit and a scroll compressor unit in a sealed container, said scroll compressor unit comprising:

a first scroll member having an end plate, a wrap of an involute curve projecting from one side of said end plate, and a rotary shaft projecting from the other side of said end plate connected to said electric motor unit;

a second scroll member having an end plate, a wrap of an involute curve projecting from one side of said end plate of said second scroll member, and a rotary shaft projecting from the other side of said end plate of said second scroll member;

a main frame rotatably supporting said shaft of said first scroll member, a subsidiary frame rotatably supporting said shaft of said second scroll member, said wrap of said first scroll member being in a juxtaposed engagement relation with said wrap of said second scroll member, and said shaft of said second scroll member being eccentrically spaced from said shaft of said first scroll member so that said wraps of said two scroll members are fitted closely together to form a plurality of compression spaces;

a driving device for rotating said second scroll member in the same direction as said first scroll member and orbiting said second scroll member relative to said first scroll member, thereby continuously compressing said compression spaces radially inwardly from an outer position to an inner position;

a limit means connected to one of said first and second scroll members for limiting axial movement of the other of said first and second scroll members; and a pressure means disposed between said limit means connected to the one said scroll member and said end plate of the other said scroll member for pressing said limit means and said end plate of the other said scroll member away from each other, said pressure means including an annular recess in said end plate facing said limit means and a passage in said end plate communicating a said compression space with said annular recess.

2. The scroll compressor of claim 1, wherein a resilient seal is provided in said annular recess and seals between said limit means and said end plate of the other said scroll member, the other said scroll member having said rotary shaft connected to said electric motor unit.

3. The scroll compressor of claim 2, wherein said resilient seal comprises an annular slidable member made of a highly wear-resistant material and a pair of annular sealing rings on said annular slidable member.

4. The scroll compressor of claim 2, wherein said resilient seal comprises a pair of annular C-section sealing rings disposed in said recess, each said sealing ring having a first flange engaging said recess and a second flange engaging said limit means.

5. The scroll compressor of claim 4, wherein each said annular C-section sealing ring has a metal wire disposed therein.

6. The scroll compressor of claim 1, wherein said limit means has a guide portion slidably guiding said driving device.

7. The scroll compressor of claim 6, wherein said rotary shaft of said second scroll member has a slide surface to which said driving device is slidably fitted.

8. A scroll compressor incorporating an electric motor unit and a scroll compressor unit in a sealed container, said scroll compressor unit comprising:

a first scroll member having an end plate, a wrap of an involute curve projecting from one side of said end plate, and a rotary shaft projecting from the other side of said end plate connected to said electric motor unit;

a second scroll member having an end plate, a wrap of an involute curve projecting from one side of said end plate of said second scroll member, and a rotary shaft projecting from the other side of said end plate of said second scroll member;

a main frame rotatably supporting said shaft of said first scroll member, a subsidiary frame rotatably supporting said shaft of said second scroll member, said wrap of said first scroll member being in a juxtaposed engagement relation with said wrap of said second scroll member, and said shaft of said second scroll member being eccentrically spaced from said shaft of said first scroll member so that said wraps of said two scroll members are fitted closely together to form a plurality of compression spaces;

rotating means for rotating said second scroll member in the same direction as said first scroll member and orbiting said second scroll member relative to said first scroll member to thereby continuously compress said compression spaces radially inwardly from an outer position to an inner position;

a limit means connected to one of said first and second scroll members for limiting axial movement of the other of said first and second scroll members; and a pressure means disposed between said limit means connected to the one said scroll member and said end plate of the other said scroll member for pressing said limit means and said end plate of the other said scroll member away from each other, wherein said rotating means and said limit means have structural components, contributing to their respective functions, in common.

9. The scroll compressor of claim 8, wherein said structural components common to both said rotating means and said limit means includes a projection integral with said end plate of said first scroll member and a bolt connected to said projection.

10. The scroll compressor of claim 9, wherein said limit means further includes a limit plate axially fixed to said end plate of said first scroll member through said projection and said bolt, said end plate of said second scroll member being disposed between said limit plate and said end plate of said first scroll member.

11. The scroll compressor of claim 10, wherein said rotating means further comprises a tubular pin on said bolt located in a guide groove in said end late of said second scroll member.

12. The scroll compressor of claim 10, wherein said pressure means comprises an annular recess in said end plate of said second scroll member facing said limit plate, a passage in said end plate communicating said annular recess with a said compression space and an annular sealing arrangement disposed in said annular recess.

13. The scroll compressor of clam 9, wherein said rotating means further comprises a tubular pin on said bolt located in a guide groove in said end plate of said second scroll member.

14. The scroll compressor of claim 8, wherein said structural components common to both said rotating means and said limit means includes a limit plate and a tubular member fixing said limit plate to said end plate of said first scroll member.

15. The scroll compressor of claim 14, wherein said tubular member retains said limit plate in an axially fixed position with said end plate of said second scroll member located between said limit plate and said end plate of said first scroll member.

16. The scroll compressor of claim 15, wherein said rotating means further includes a ring member disposed in a key groove in said limit plate for linear movement therein, said ring member slidably receiving said rotary shaft of said second scroll member therein for sliding movement in a direction perpendicular to said key groove.

17. The scroll compressor of claim 15, wherein said pressure means comprises an annular recess in said end plate of said second scroll member facing said limit plate, a passage in said end plate communicating said annular recess with a said compression space, and an annular sealing arrangement disposed in said annular recess.

18. The scroll compressor of claim 14, wherein said pressure means comprises an annular recess in said end plate of said second scroll member facing said limit plate, a passage in said end plate communicating said annular recess with a said compression space, and an annular sealing arrangement disposed in said annular recess.

19. The scroll compressor of claim 14, wherein said rotating means further includes a ring member disposed in a key groove in said limit plate for linear movement therein, said ring member slidably receiving said rotary shaft of said second scroll member therein for sliding movement in a direction perpendicular to said key groove.

* * * * *